US008997282B2

(12) United States Patent
Bossingham et al.

(10) Patent No.: US 8,997,282 B2
(45) Date of Patent: Apr. 7, 2015

(54) BED WITH A POWERED WIDTH EXPANSION WING

(75) Inventors: Robert Bossingham, Morristown, IN (US); Stephen E Hutchison, Batesville, IN (US); Jeffrey A Ruschke, Lawrenceburg, IN (US); James D Lattimore, Batesville, IN (US); M Tyler Rigsby, Cincinnati, OH (US); John D Christie, Batesville, IN (US); Brian Guthrie, Greensburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 248 days.

(21) Appl. No.: 13/468,424

(22) Filed: May 10, 2012

(65) Prior Publication Data

US 2013/0298331 A1 Nov. 14, 2013

(51) Int. Cl.

| | |
|---|---|
| ***A47B 7/00*** | (2006.01) |
| ***A47B 7/02*** | (2006.01) |
| ***A61G 7/002*** | (2006.01) |
| ***A61G 7/018*** | (2006.01) |
| ***A61G 7/05*** | (2006.01) |
| *A61G 13/12* | (2006.01) |

(52) U.S. Cl.

CPC ..... *A61G 7/002* (2013.01); *A61G 7/018* (2013.01); *A61G 7/05* (2013.01); *A61G 7/0507* (2013.01); *A61G 13/129* (2013.01); *A61G 2200/16* (2013.01)

(58) Field of Classification Search

CPC ..... A61G 13/129; A61G 7/018; A61G 7/002
USPC ..... 5/251, 600, 613–620
See application file for complete search history.

(56) References Cited

U.S. PATENT DOCUMENTS

| | | | | |
|---|---|---|---|---|
| RE19,272 | E * | 8/1934 | Kurkchee | 5/183 |
| 3,081,463 | A * | 3/1963 | Williams et al. | 5/616 |
| 4,805,249 | A | 2/1989 | Usman et al. | |
| 6,357,065 | B1 | 3/2002 | Adams | |
| 7,406,729 | B2 * | 8/2008 | Hornbach et al. | 5/613 |

(Continued)

OTHER PUBLICATIONS

European Search Report for European Application No. 13166067.2; Place of Search—The Hague; Date of completion of the search—Feb. 17, 2014.

(Continued)

*Primary Examiner* — Robert G Santos
*Assistant Examiner* — David E Sosnowski
(74) *Attorney, Agent, or Firm* — Kenneth C. Baran

(57) ABSTRACT

A method for governing care of a person includes determining the importance of a candidate activity (84) relative to the importance of patient sleep continuity (104) and, if the candidate activity is more important than sleep continuity, carrying out the activity or indicating the acceptability of carrying out the activity (106) and, if the candidate activity is not more important than sleep continuity, refraining from carrying out the activity or indicating the unacceptability of carrying out the activity (108). A system for patient care governance comprises a decision engine (80) for determining the importance of the candidate activity relative to the importance of sleep continuity, and a controller (92) responsive to the decision engine for issuing a command to carry out the activity or indicate the acceptability of carrying out the activity (106), refrain from carrying out the activity or indicate the unacceptability of carrying out the activity (108).

9 Claims, 15 Drawing Sheets

(56) References Cited

U.S. PATENT DOCUMENTS

| | | | | |
|---|---|---|---|---|
| 7,730,562 | B2 | 6/2010 | Hornbach et al. | |
| 8,056,163 | B2 * | 11/2011 | Lemire et al. | 5/611 |
| 8,104,122 | B2 * | 1/2012 | Richards et al. | 5/618 |
| 8,418,291 | B2 * | 4/2013 | Hornbach et al. | 5/618 |
| 8,621,690 | B2 * | 1/2014 | Hornbach et al. | 5/613 |
| 8,635,727 | B2 * | 1/2014 | Dahlin et al. | 5/716 |
| 8,650,686 | B2 * | 2/2014 | Biggie et al. | 5/713 |
| 8,719,980 | B2 * | 5/2014 | Chen | 5/613 |
| 8,800,080 | B2 * | 8/2014 | Kay et al. | 5/618 |
| 2006/0026767 | A1 | 2/2006 | Chambers et al. | |
| 2008/0282472 | A1 * | 11/2008 | Hornbach et al. | 5/616 |
| 2010/0005592 | A1 * | 1/2010 | Poulos et al. | 5/618 |
| 2013/0227787 | A1 * | 9/2013 | Herbst et al. | 5/611 |
| 2013/0232690 | A1 * | 9/2013 | Hornbach et al. | 5/614 |
| 2013/0298331 | A1 * | 11/2013 | Bossingham et al. | 5/613 |
| 2014/0026325 | A1 * | 1/2014 | Guthrie | 5/709 |
| 2014/0047641 | A1 * | 2/2014 | Thodupunuri et al. | 5/613 |
| 2014/0215717 | A1 * | 8/2014 | Rigsby et al. | 5/613 |

OTHER PUBLICATIONS

European Search Report Response for European Application No. 13166067.2, dated Sep. 24, 2014.

Specification as filed for European Application No. 13166067.2.

Claims as filed for European Application No. 13166067.2.

* cited by examiner

BED WITH A POWERED WIDTH EXPANSION WING

TECHNICAL FIELD

The subject matter described herein relates to beds of the type used in hospitals, other health care facilities and home health care settings, in particular a bed having at least one powered width expansion wing.

BACKGROUND

Beds used in hospitals, other health care facilities and home health care settings include a deck and a mattress supported by the deck. Some beds have a fixed width deck. Other beds include a fixed width center deck section, a left width adjustment wing and a right width adjustment wing. The wings can be stored under the fixed width center section, in which case the deck width equals the width of the fixed width section. The wings can also be stored partially under the fixed width center section so that they each project laterally beyond the lateral edges of the center section by a distance D1, in which case the deck width equals the width of the fixed width section plus two times the distance D1. The wings can also be deployed so that they each project laterally beyond the lateral edges of the fixed width section by a distance D2, which is greater than D1, in which case the deck width equals the width of the fixed width section plus two times the distance D2. With the wings deployed, the bed may be outfitted with a bariatric mattress, which is wider than a nonbariatric mattress, to accommodate a bariatric occupant. A typical bariatric mattress has a center section, a left width augmentation section and a right width augmentation section. Examples of augmentation sections include air filled bladders and foam inserts. The width adjustment wings are useful because with the wings deployed in order to accommodate a bariatric occupant the bed is too wide to fit through a typical doorway. When it becomes necessary to transport the occupant to a different location without removing him or her from the bed, the wings can be temporarily moved to their stored position and the mattress can be temporarily reduced in width, for example by deflating the augmentation bladders or laterally compressing the augmentation foam, so that the bed is able to fit through the doorways. Upon reaching the intended destination the bed can then be restored to its bariatric configuration, i.e. with the wings deployed and the mattress re-expanded to its bariatric width.

In a typical width adjustable bed the stored position of the wings is underneath the fixed width deck section. A caregiver deploys the wings by manually pulling them laterally away from the longitudinal centerline of the bed, and stores them by manually pushing them laterally toward the centerline. U.S. Pat. No. 7,730,562 describes a bed having powered width expansion wings. The only specific means disclosed for powering the wings are a hydraulic cylinder or a linear actuator. Such actuation devices can suffer from disadvantages such as bulk, weight and cost. Accordingly, it is desirable to devise more compact, lightweight, low cost systems for powering the expansion wings without sacrificing simplicity and reliability. It is also desirable if such systems can be retrofit onto existing beds having manually operated wings. It is also desirable if such systems or their components can be economically and easily repaired or replaced when necessary.

SUMMARY

A bed disclosed herein comprises a fixed width section having a width and an outboard edge, a wing movably coupled to the fixed width section, a motor assembly mechanically grounded to one of the fixed width section and the wing, and a lead screw coupled to the motor assembly and to a lead screw receiver nonmovably associated with the other of the fixed width section and the wing. In practice, operation of the motor is capable of moving the wing between a deployed position in which a lateral extremity thereof is outboard of the outboard edge and a stored position in which the lateral extremity is inboard of its deployed position.

A retrofit kit as disclosed herein for upgrading a host bed having manually operable width extension wings comprises a motor assembly, a bracket for mounting the motor assembly to a bed frame, a lead screw set comprising oppositely handed lead screws each attachable to the motor assembly, and a lead screw support bracket set. Each member of the support bracket set is securable to a width extension wing of the host bed. The members of the support bracket set have oppositely handed lead screw receivers.

BRIEF DESCRIPTION OF THE DRAWINGS

The foregoing and other features of the various embodiments of the width adjustable bed and retrofit kit described herein will become more apparent from the following detailed description and the accompanying drawings in which.

DETAILED DESCRIPTION

Figure 1:
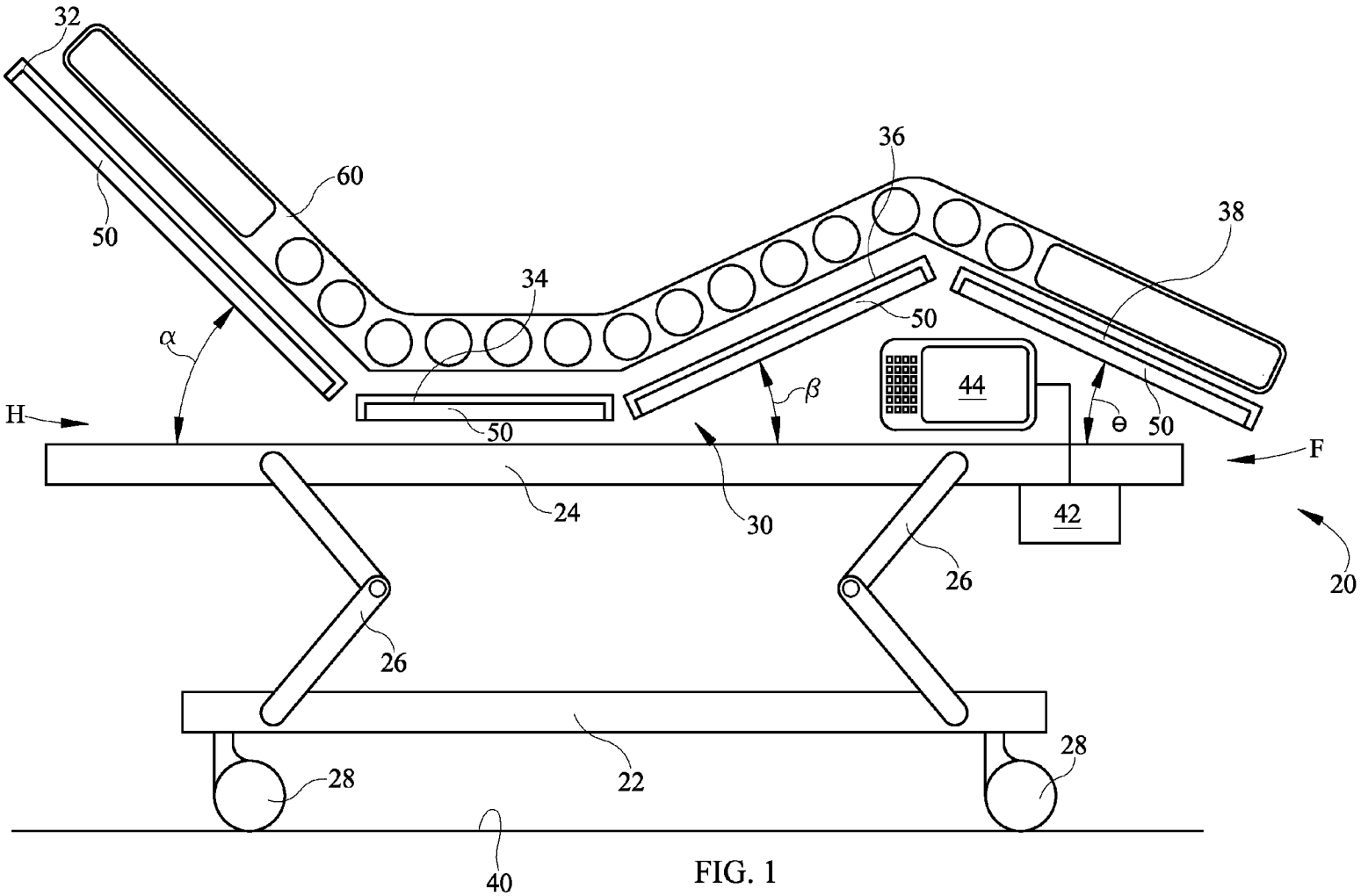
FIG. 1 is a simplified schematic right side elevation view of a hospital bed.
Figure 2:
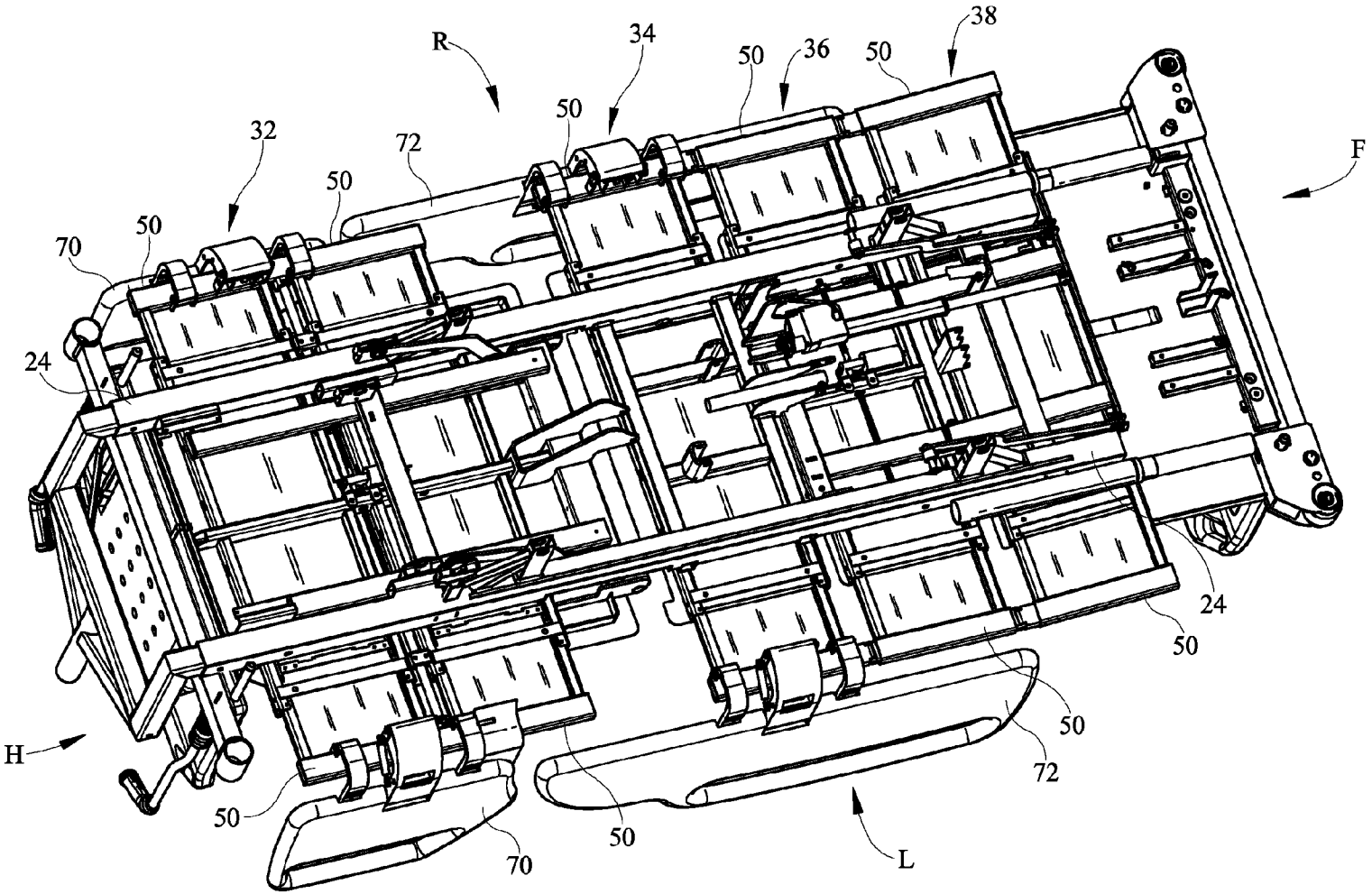
FIG. 2 is a perspective view of a hospital bed deck having a fixed width center deck section, a left width adjustment wing and a right width adjustment wing as seen by an observer looking from beneath the deck.

Referring to FIGS. 1 and 2 a hospital bed 20 includes a base frame 22 and an elevatable frame 24. A lift system represented by links 26 renders the elevatable frame vertically moveable relative to the base frame. The bed extends longitudinally from a head end H to a foot end F and laterally from a right side R (seen in the plane of the illustration) to a left side L. Casters 28 extend from the base frame to floor 40. The elevatable frame 24 includes a deck 30 comprising longitudinally distributed deck segments. The deck segments include an upper body or torso deck segment 32 corresponding approximately to an occupant's torso, a seat deck segment 34 corresponding approximately to an occupant's buttocks, a thigh deck segment 36 corresponding approximately to an occupant's thighs, and a calf deck segment 38 corresponding approximately to an occupant's calves. The upper body, calf, and thigh deck segments are orientation adjustable through angles $\alpha$, $\beta$ and $\theta$. The bed also includes a controller 42 for controlling various functions of the bed and a user interface 44 in communication with the controller.

Deck segments 32, 34, 36, 38 are width adjustable segments that include wings 50 movably coupled to a fixed width center section 52. The fixed width center section has a width WF measured between left and right outboard edges 54, 56. In the illustration all four segments are width adjustable segments with both left and right wings. Alternatively, one or more wings could be coupled to only one side (left or right) of the bed. The illustrated bed has ten wings, two of which (one left and one right) are coupled to each of the seat, thigh and calf segments and four of which (two left and two right) are coupled to the upper body segment. A mattress 60 rests on the deck.

Figure 3:
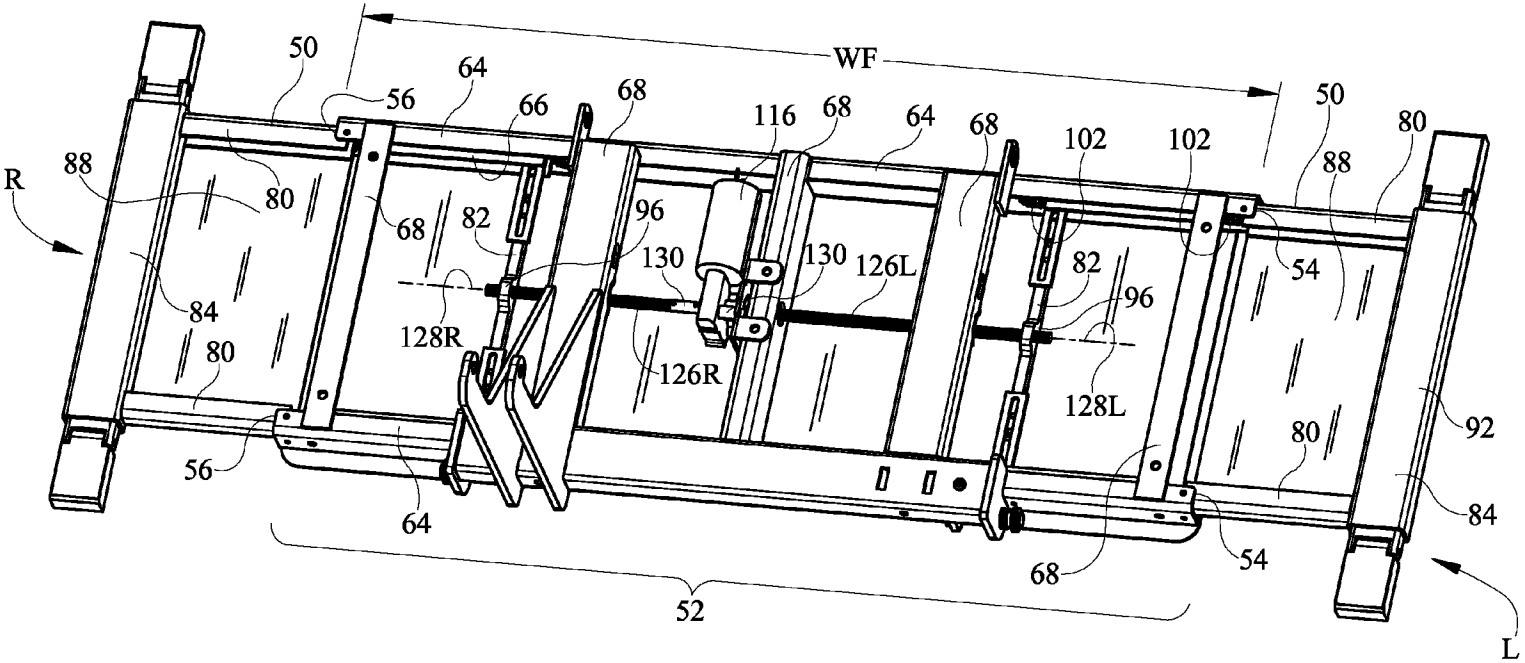
FIG. 3 is a view of a typical deck segment, specifically a thigh deck segment, as seen by an observer looking from beneath the segment.
Figure 4:
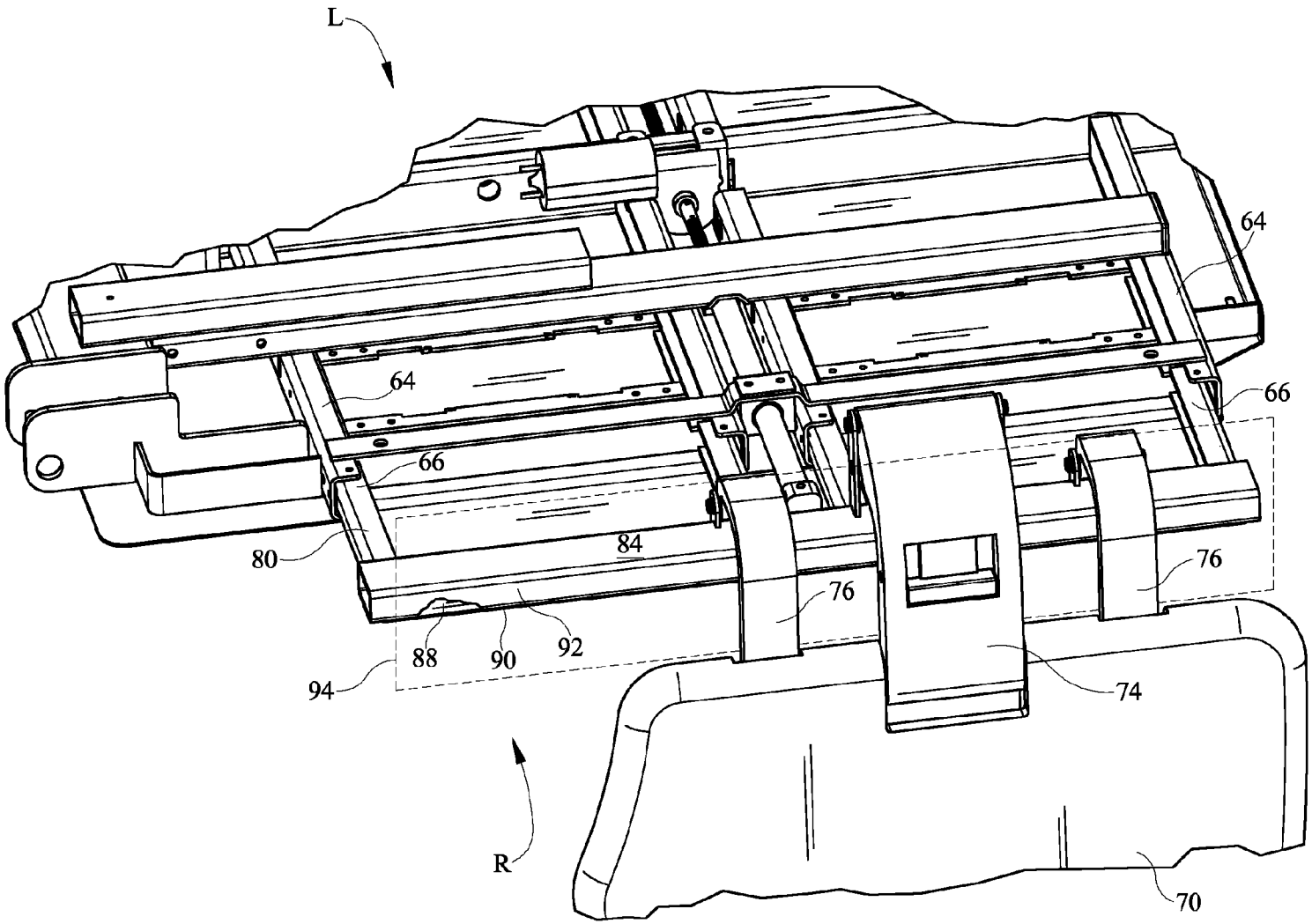
FIG. 4 is a perspective view showing the right outboard portion of a typical deck segment, specifically an upper body deck segment, as seen by an observer looking from beneath the segment.

As seen in FIG. 3, a typical deck segment includes a pair of longitudinally spaced apart crossbars 64, connected together by longitudinally extending rails 68. The illustrated crossbars are in the form of C-channels having open sides 66 (seen best in FIG. 4) that face toward each other.

The bed also includes left and right head end siderails 70, and left and right foot end siderails 72. As seen most clearly in FIG. 4, each siderail is connected to a wing 50 by a center link 74 and a longitudinally split link 76 such that the siderail 70 or 72, wing 50 and links 74, 76 comprise a four bar linkage which enables a user to vertically raise and lower the siderail.

Figure 6:
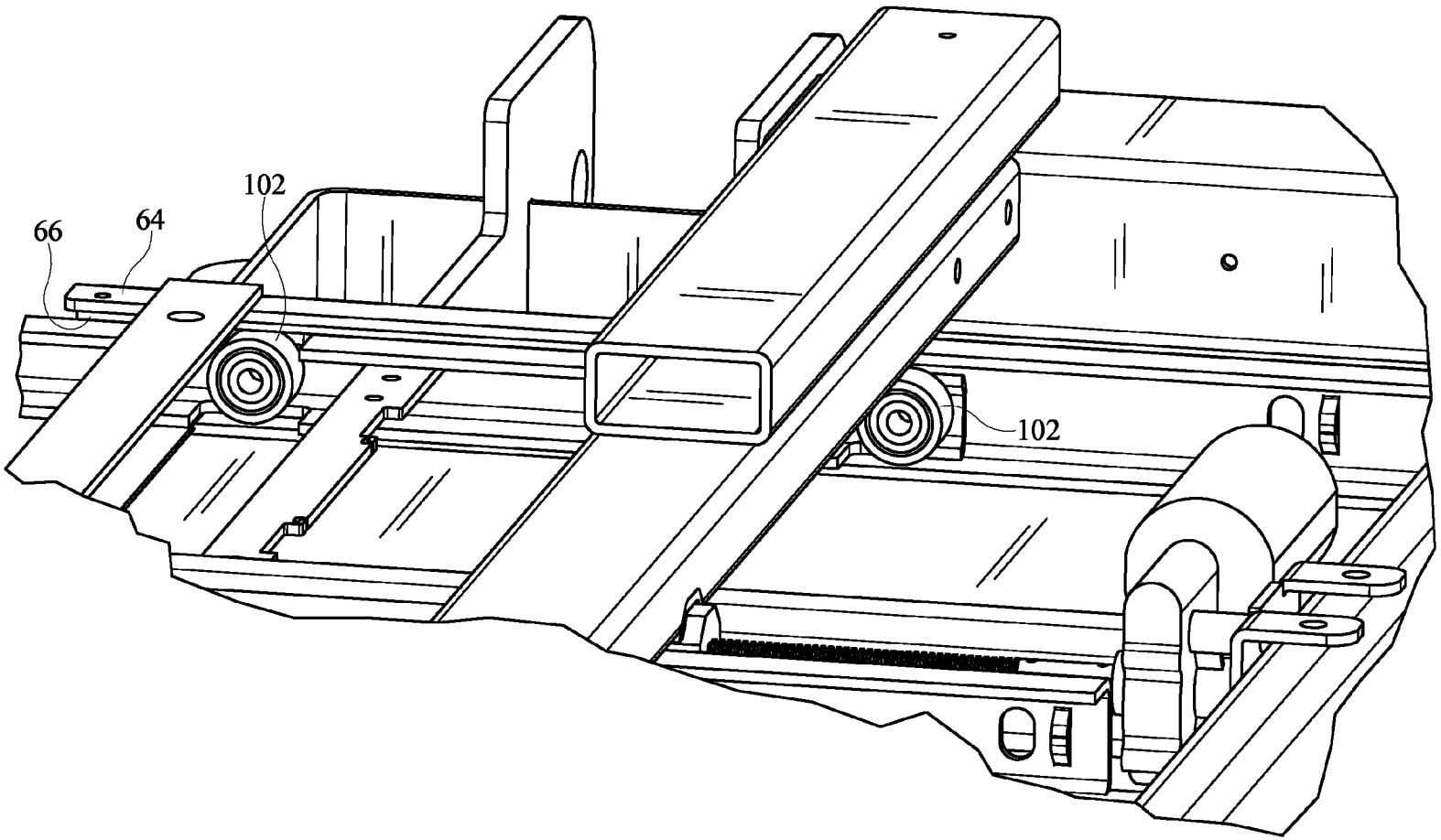
FIG. 6 is a view of a portion of a deck segment as seen by an observer looking from beneath the segment showing part of a width expansion wing in relation to a crossbar of a bed frame.

Each wing comprises a pair of longitudinally spaced apart spars 80, an inboard connector 82 (also referred to as a lead screw support bracket) spanning longitudinally between the spars at their inboard ends, an outboard beam 84 spanning longitudinally between the spars at their outboard ends, and a panel 88 extending between the spars and overlying the outboard beam. As seen best in FIG. 4, outboard edge 90 of panel 88 and outboard face 92 of beam 84 lie in approximately a common vertical plane 94 and therefore define the outboard lateral extremity of the wing. Connector 82 includes a lead screw receiver 96 comprising a threaded bore 98 (seen best in FIGS. 14-15) that penetrates through the connector. The receivers on the left and right wings are oppositely handed and each receiver is nonmovable relative to its respective wing. Each wing spar 80 nests in one of the deck segment C-channels 64 so that the spars, and therefore the wing, are laterally translatable relative to fixed width section 52. As seen best in FIG. 6, the illustrated embodiment includes bearings 102 rotatably attached to the spars to reduce resistance when the wings translate relative to the fixed section. Other types of interfaces between the spars and the C-channels, such as rollers, could also be used.

Figure 7:
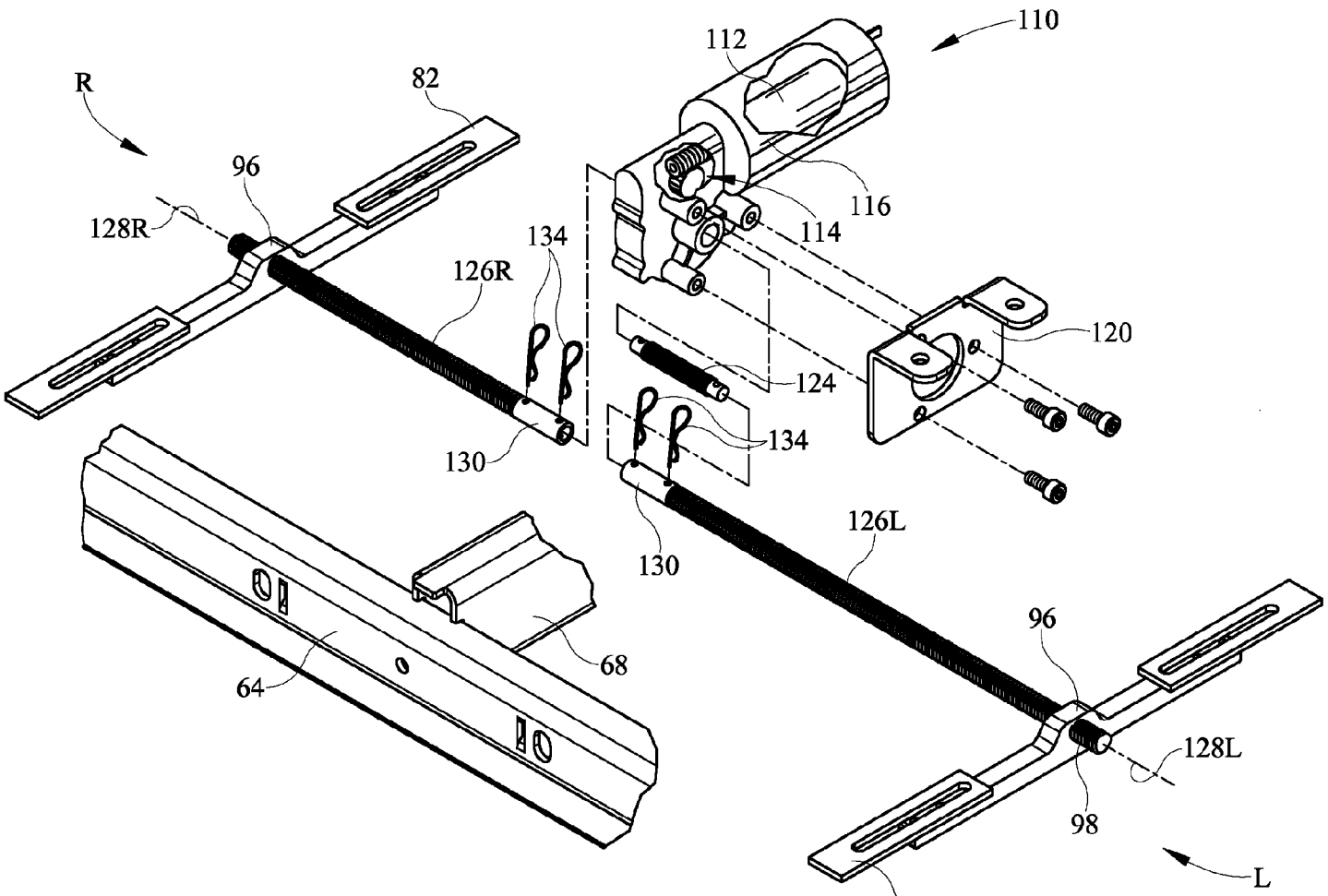
FIG. 7 is a partially exploded perspective view of a motor assembly, a motor mounting bracket, a coupling shaft, a pair of a lead screws, and a coupling collar shown in the context of a bed frame crossbar and an inboard connector component of a typical width expansion wing.

Referring additionally to FIG. 7, the bed also includes a motor assembly 110 comprising an electric motor 112 and a gear train 114, such as a worm and pinion, housed in a housing 116. The motor assembly is mechanically grounded to fixed width section 52. Specifically the motor assembly is bolted to a motor mounting bracket 120 which itself is bolted to rail 68. A coupling shaft 124, which is rotatably driven by the gear train, projects out of the left and right sides of housing 116. One end of a lead screw 126L having a rotational axis 128L is coupled to one end of shaft 124, and therefore to motor assembly 110, by a coupling collar 130 and a pair of R-pins 134. The other end of lead screw 126L is received in receiver 96 of left wing 50L. Another lead screw 126R is coupled to the other end of shaft 124, and therefore to motor assembly 110, by another coupling collar 130 and an additional pair of R-pins 134. The other end of lead screw 126R is received in receiver 96 of right wing 50R so that its rotational axis 128R is colinear with axis 128L. The colinear axes 128L, 128R define a common rotational axis for the lead screws. Lead screws 128L, 128R are oppositely handed as are the lead screw receivers in the left and right wings. Each lead screw and its receiver are same-handed.

Figure 8:
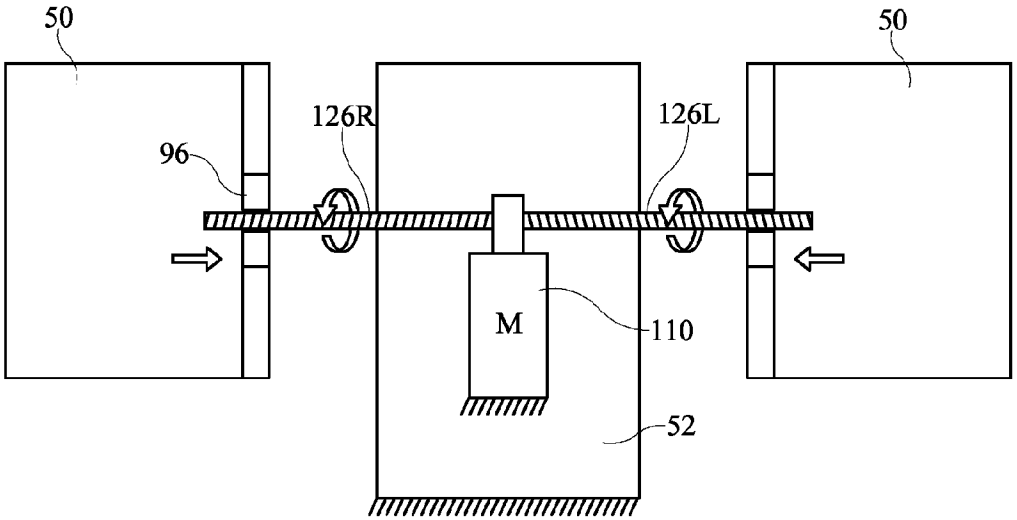
FIGS. 8-9 are schematic plan views comparing kinematic inversions of beds with width expansion wings.
Figure 9:
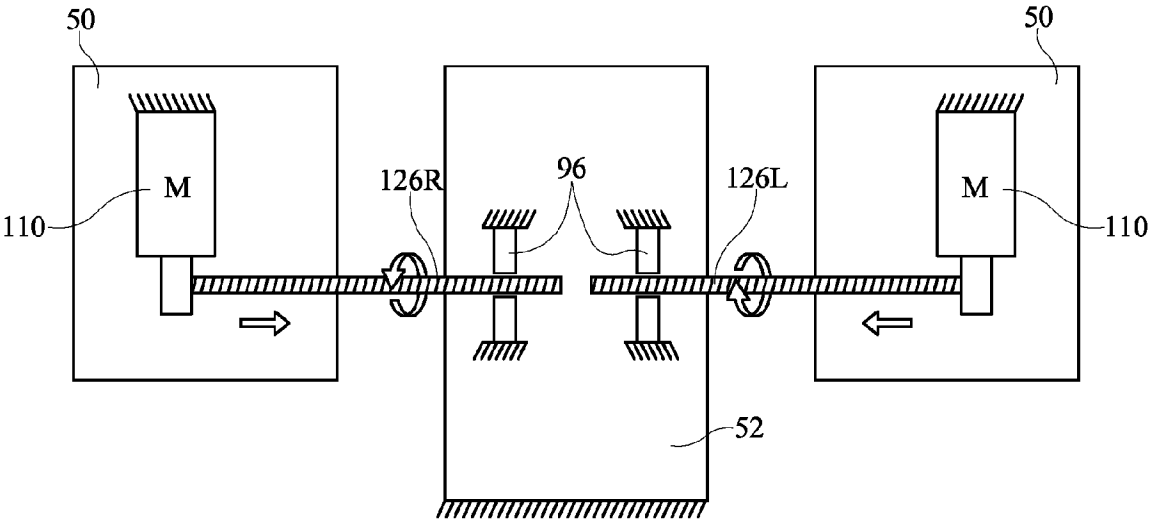

FIG. 8 schematically show the above described kinematic arrangement in which the motor assembly 110 is mechanically grounded to fixed width section 52 and the lead screw receivers are nonmovably associated with each wing. FIG. 9 shows a kinematic inversion in which a motor assembly 110 is mechanically grounded to each wing 50 and the lead screw receivers are nonmovably associated with fixed width sections 52. In the architecture of FIG. 9 coordination of the direction of movement of the width expansion wings can be accomplished with oppositely handed lead screws or with opposite motor rotational directions.

Figure 5B:
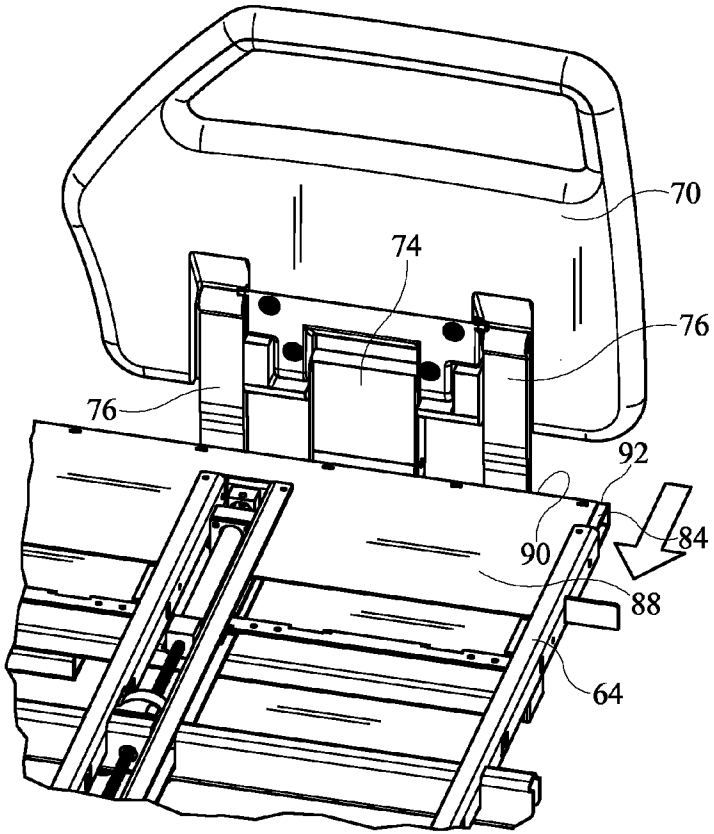
FIGS. 5A and 5B are perspective views showing the right outboard portion of a typical deck segment, specifically a torso deck segment, with a width adjustment wing in its deployed state (FIG. 5A) and its stored state (FIG. 5B) as seen by an observer looking from above the segment. A deck plate which rests atop the deck framework is absent from the illustration in order to expose to view components that would otherwise be obscured.
Figure 5A:
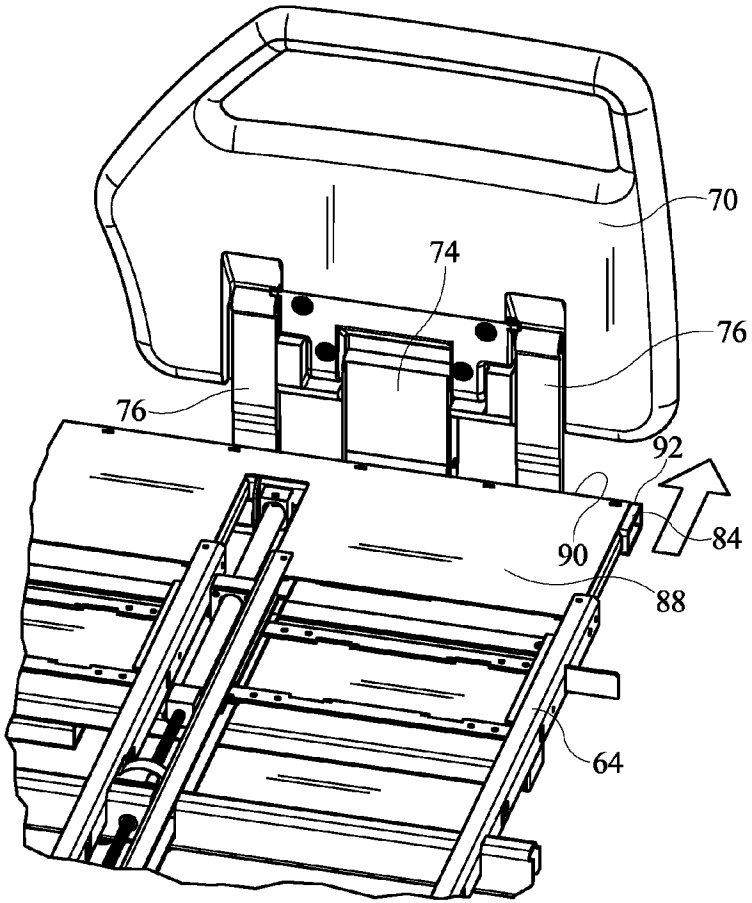
Figure 10:
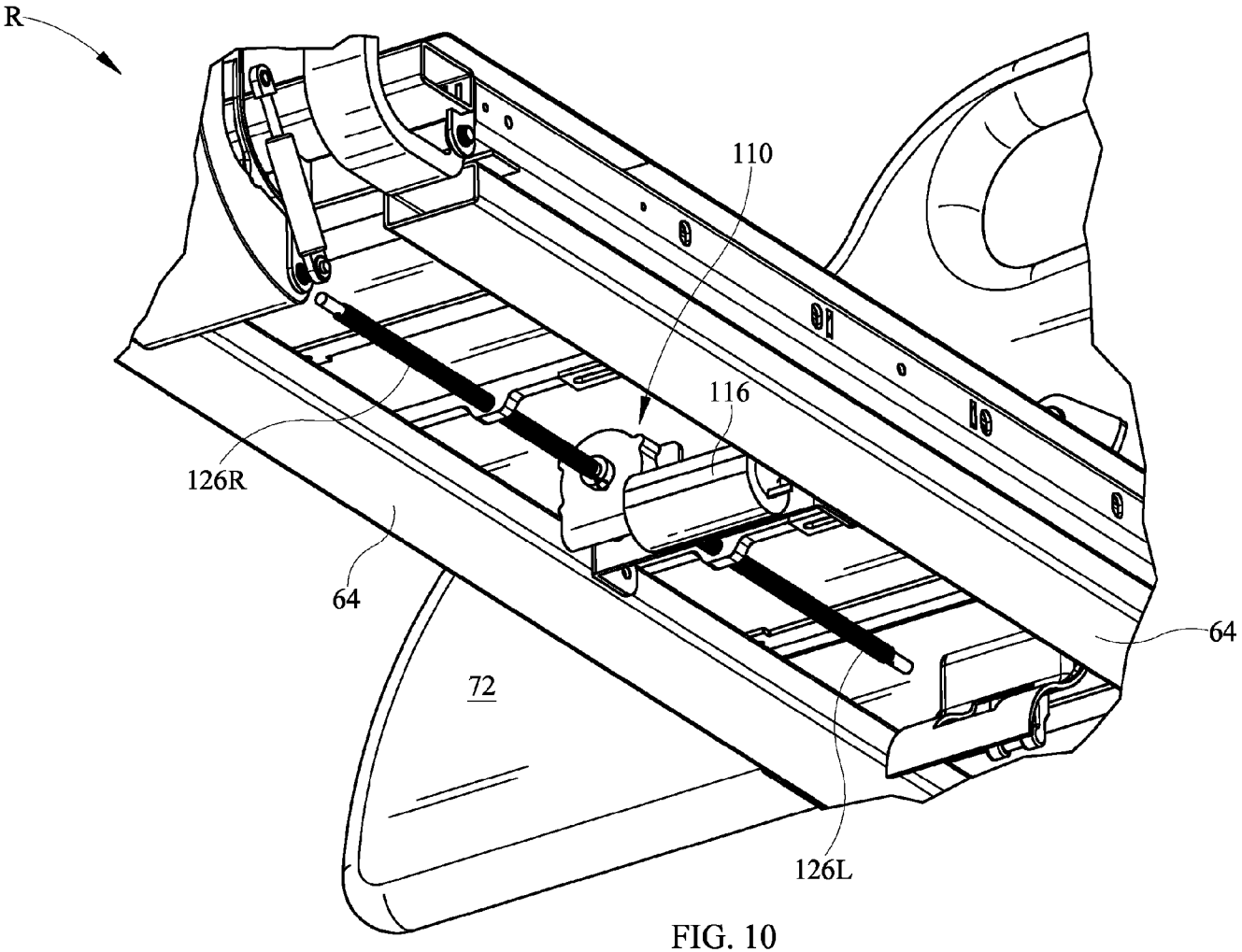
FIG. 10 is a perspective view of a portion of a seat deck segment as seen from beneath the segment showing an alternative mounting bracket for the motor assembly and also showing the width expansion wings in their stored positions.

In practice, operation of the motor in a first rotational direction moves the left and right wings in unison in a laterally outboard direction. Operation of the motor in a second rotational direction, opposite that of the first rotational direction, moves the wings in unison in a laterally inboard direction. In particular the motor can move the wings between a deployed position in which the lateral extremity 92 of the wing is outboard of the outboard edge 56 or 58 of the fixed width section 52 (e.g. FIGS. 2-5A) and a stored position in which the lateral extremity 92 is inboard of its deployed position (FIGS. 5B, 10). When the wing is stored its outboard extremity 94 may be outboard of, inboard of, or substantially laterally aligned with outboard edge 56 or 58 of fixed width section 52.

Figure 11:
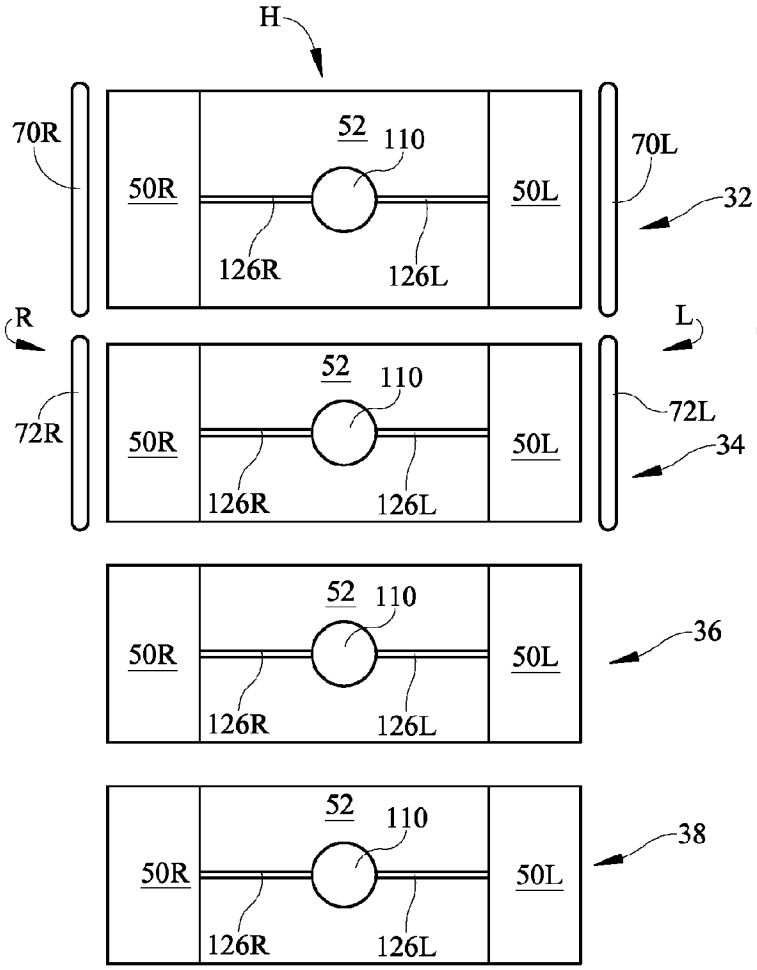
FIG. 11 is a schematic plan view of a bed with width expansion wings coupled to each of four deck segments and with a dedicated motor associated with each segment.

FIG. 11 is a schematic representation of the above described architecture having four deck segments, all four of which are width adjustable. The motor (or a set of motors in the variant in which the motors are mechanically grounded to the wings) is associated with and dedicated to one and only one of the four segments 32, 34, 36, 38. In other words each width adjustable segment has a dedicated motor assembly associated with it for moving the wings coupled to that same segment. In general, in a bed having at least two deck segments, and in which at least two of those segments are width adjustable segments, each segment is serviced by its own dedicated motor assembly or assemblies.

Figure 12:
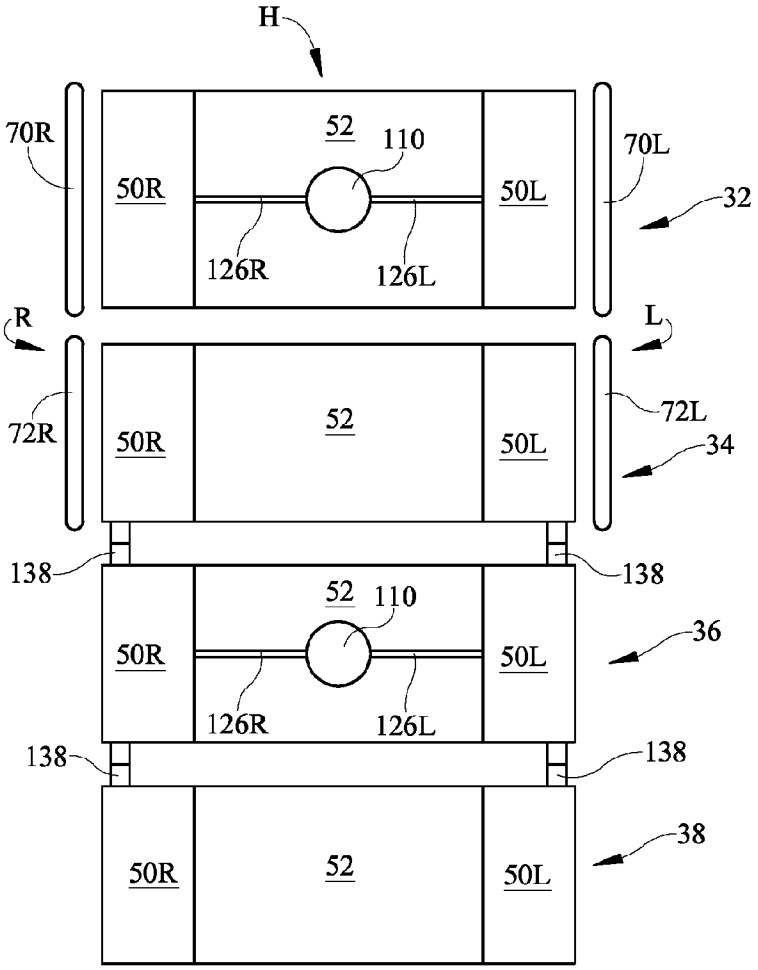
FIG. 12 is a view similar to that of FIG. 11 showing an architecture in which a common motor services the width expansion wings of more than one deck segment.
Figure 13:
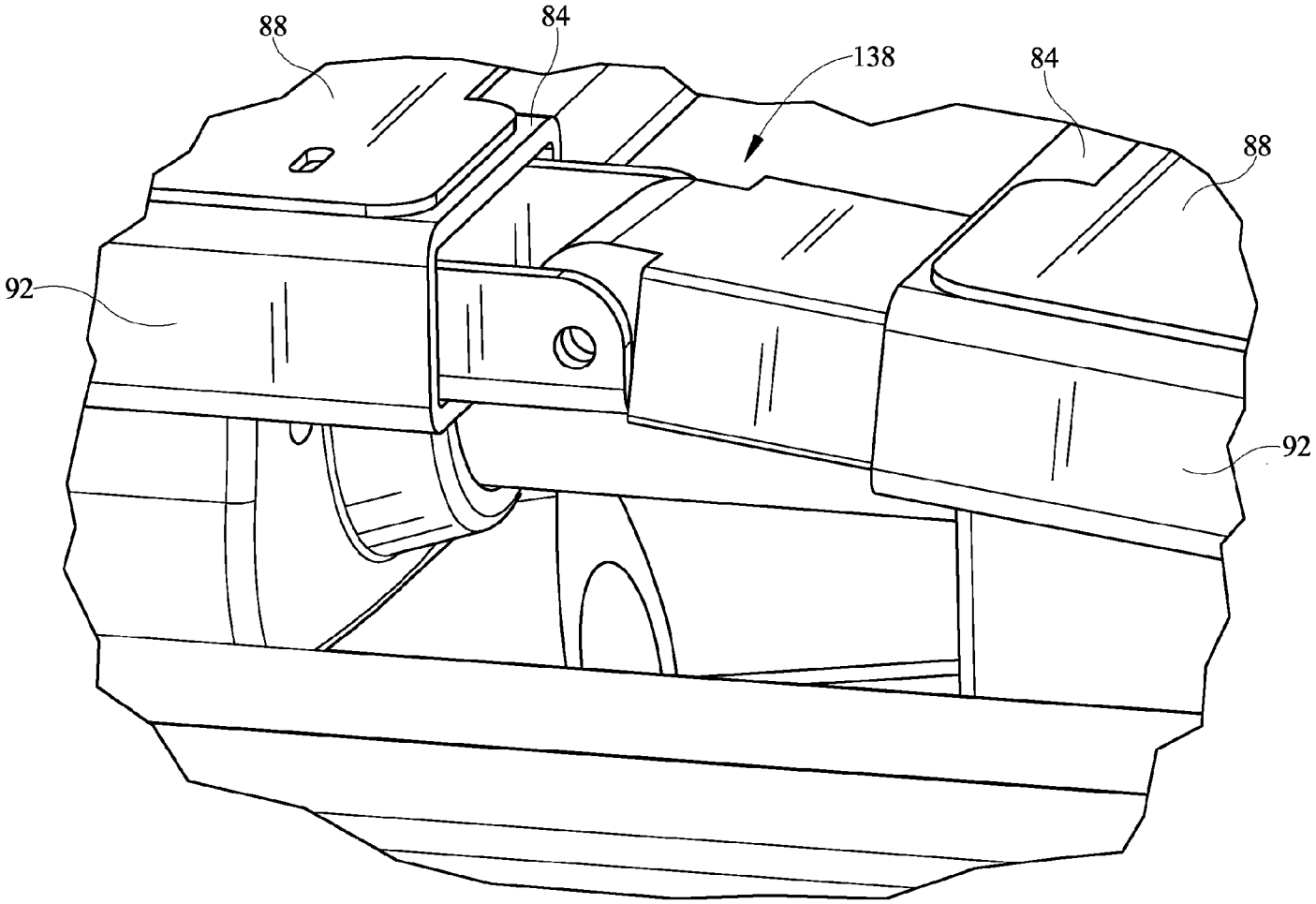
FIG. 13 is a side view showing a link connecting the width expansion wings of neighboring deck segments.

FIGS. 12-13 show an alternative in which the wings of at least two of the width adjustable segments are movable by a common motor assembly. Specifically, a motor assembly 110 is mechanically grounded to center section 52 of thigh deck segment 36. Wings 50 of segment 36 are master wings driven directly by the common motor assembly. Wings 50, of the seat and calf segments 36, 38 are slave wings connected to the master wing by a link 138 which conveys the lateral motion of the master wings to the slave wings. The slave wings are considered to be indirectly driven because the master wings intervene between the motor assembly and the slave wings. The wings of the upper body section of FIG. 9 are serviced by a motor dedicated to the upper body section.

Figure 15:
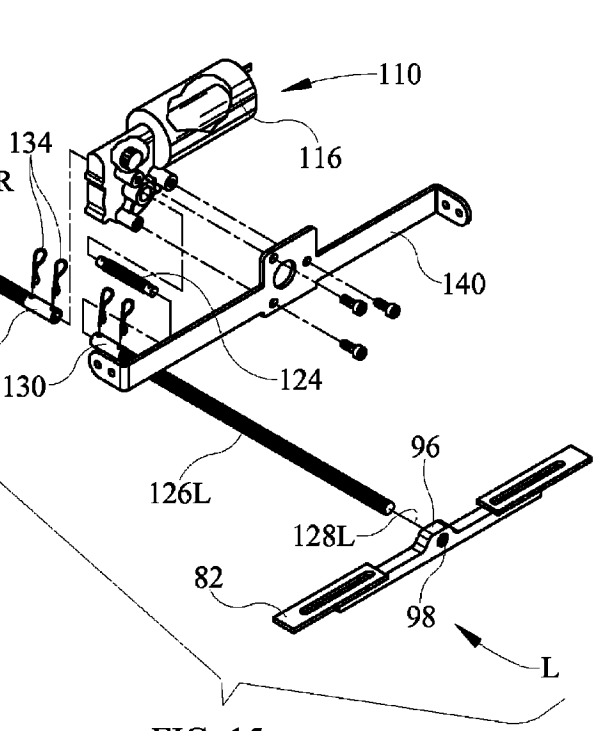
FIG. 15 is a perspective view of components of an alternative retrofit kit for upgrading a bed having manually operated width expansion wings, the kit including an alternative motor assembly mounting bracket for attaching a motor assembly to a bed frame that does not already include a frame component suitable for mounting the motor assembly.
Figure 14:
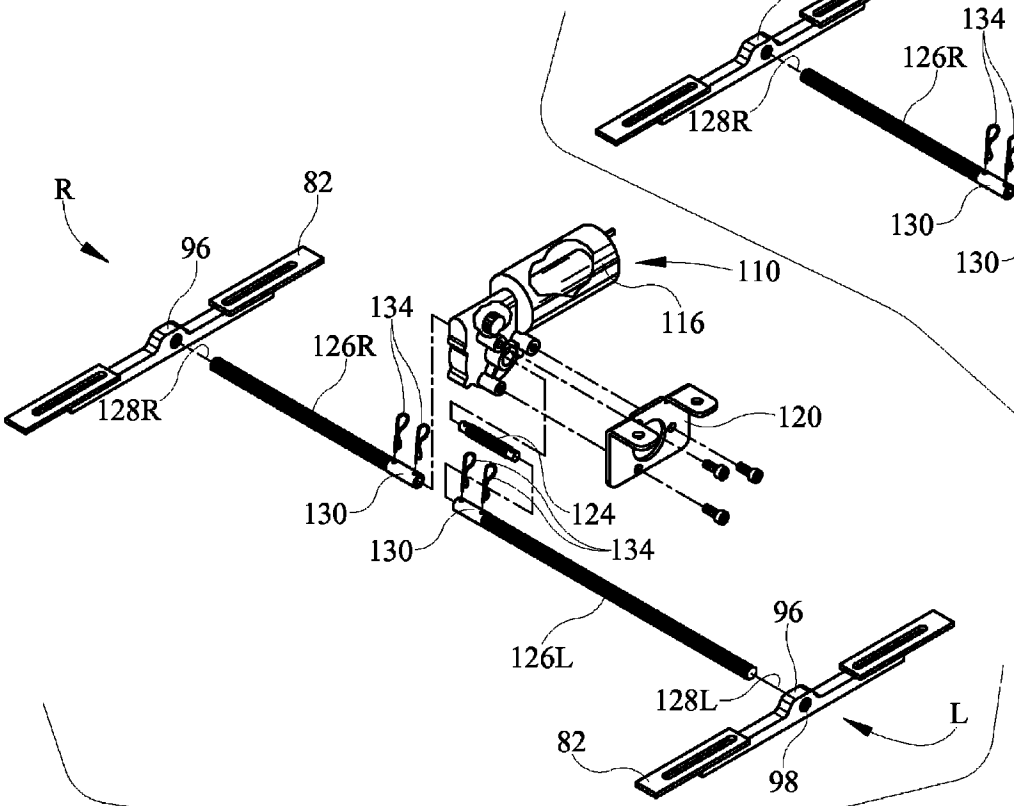
FIG. 14 is a perspective view of components of a retrofit kit for upgrading a bed having manually operated width expansion wings, the kit including a motor assembly mounting bracket for attaching a motor assembly to a suitably located bed frame component.

The foregoing explanation and accompanying illustrations are directed to beds manufactured with the powered width adjustment feature. However a retrofit kit may be provided for upgrading beds having manually operable width expansion wings. As seen in FIGS. 14-15 a retrofit kit includes at least a motor assembly 110, a motor mount bracket 120 (FIG. 14) or 140 (FIG. 15) for mounting the motor assembly to a bed frame, a lead screw set comprising oppositely handed lead screws 126L, 126R each of which is attachable to the motor assembly, and a lead screw support bracket set comprising a pair of lead screw support brackets 82. The members of the lead screw support bracket set have oppositely handed lead screw receivers 96 and are securable to a width extension wing e.g. by welds or bolts. Other hardware such as a coupler shaft 124, coupling collars 130, R-clips 134 and other fasteners may also be part of the kit. Although FIGS. 14-15 show several kit components as individual parts, certain kit components, such as the motor assembly and motor mount bracket, can be preassembled to each other rather than provided as individual components.

Figure 16:
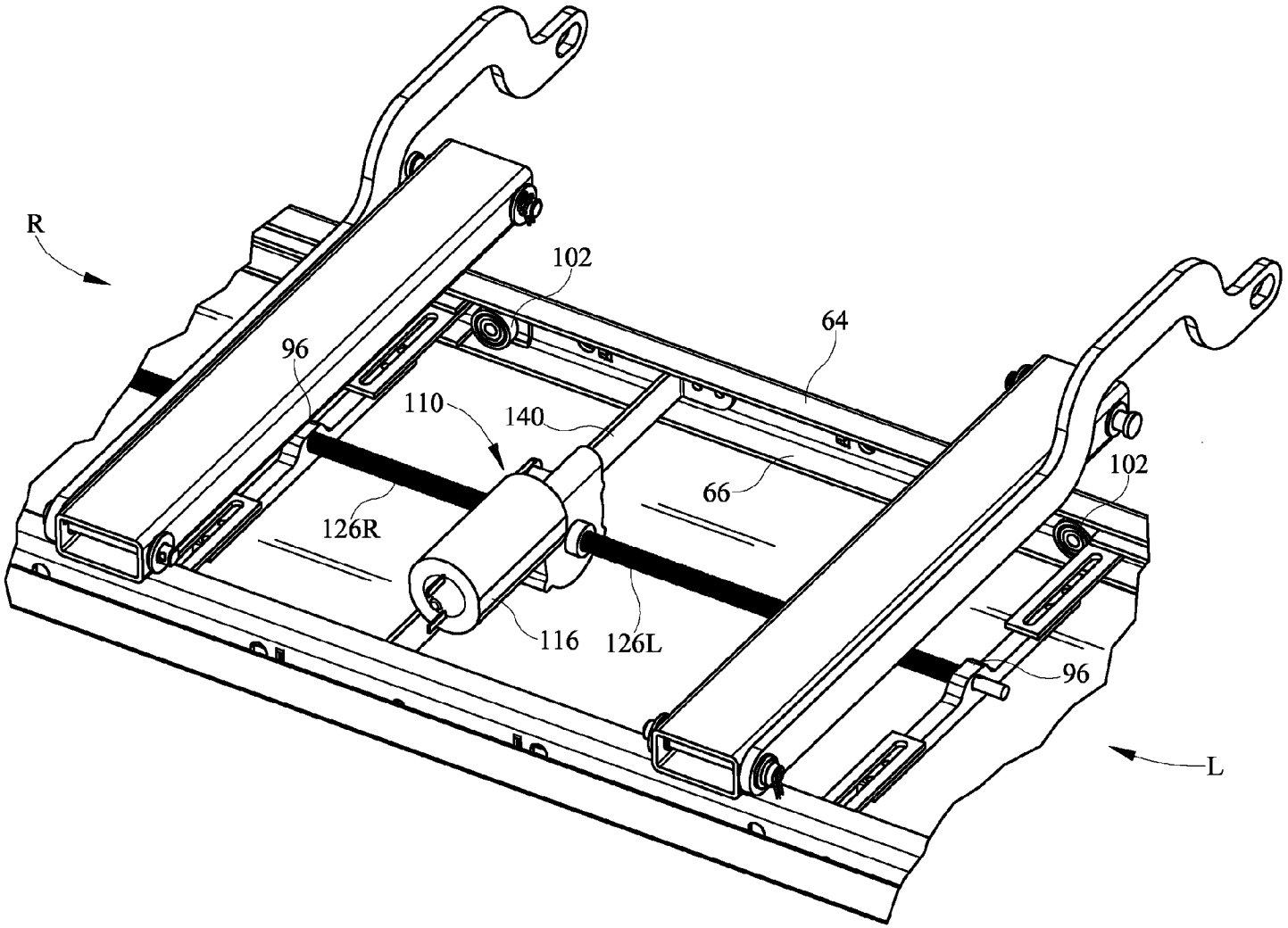
FIGS. 16-18 are perspective views of a portion of a deck segment, as seen from beneath the segment, showing the alternative bracket of FIG. 15 used to mount a motor assembly.
Figure 17:
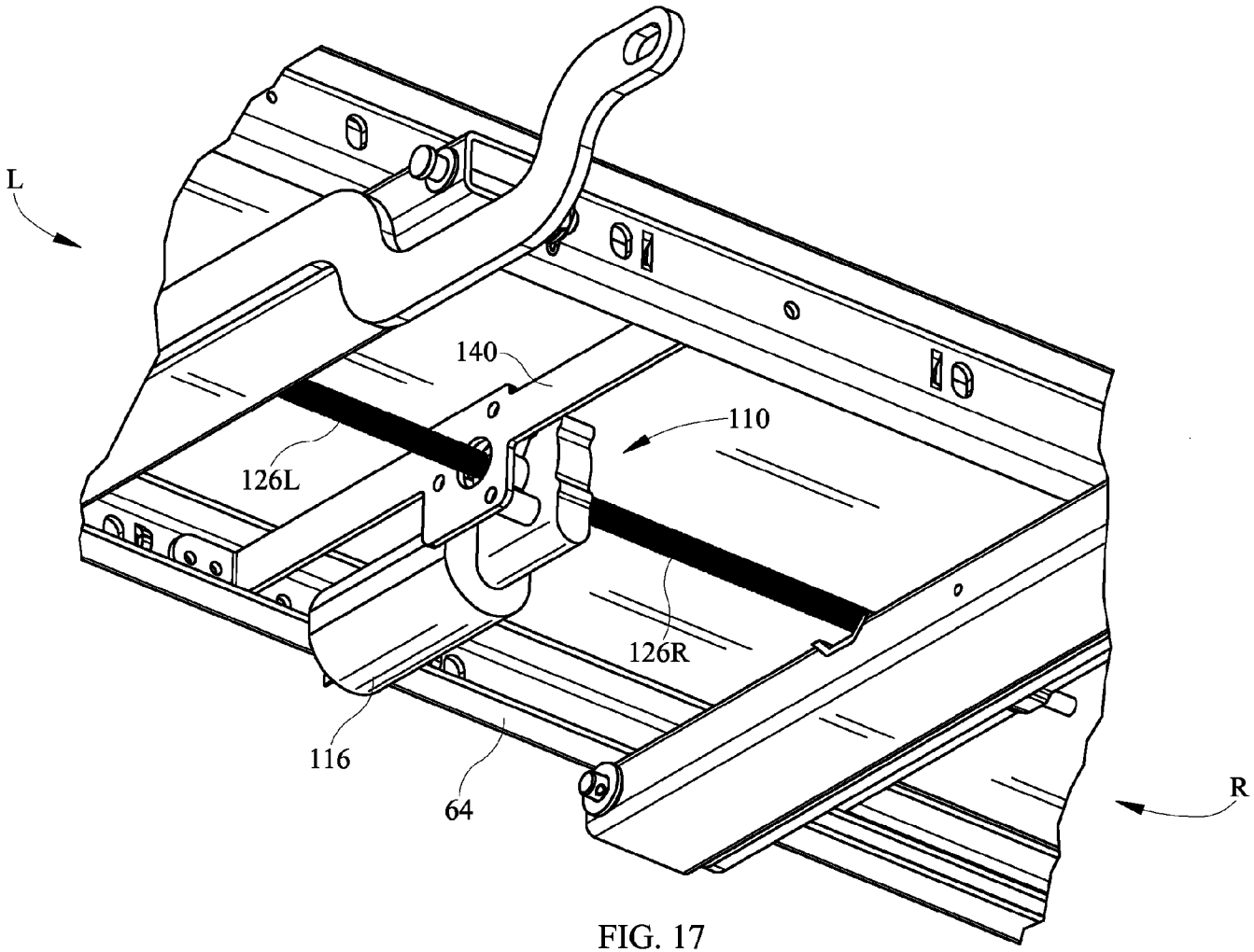
Figure 18:
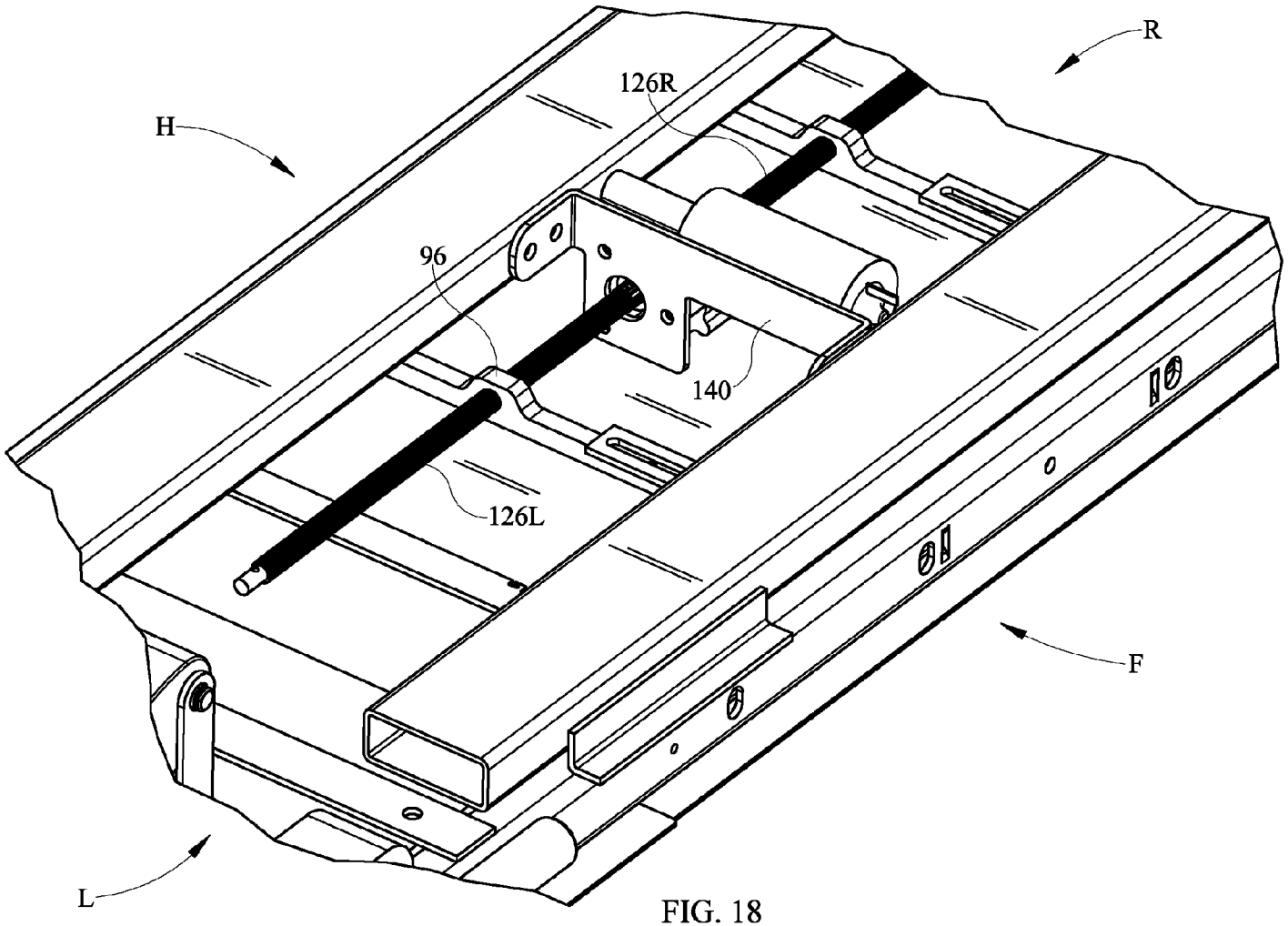

FIGS. 14 and 15 show two different styles of motor mount brackets. Motor mount bracket 120 of FIG. 14 is configured to attach the motor assembly to a preexisting, longitudinally extending rail 68 of the bed frame, for example rail 68 of FIG. 3. Motor mount bracket 140 of FIG. 15 is configured to span longitudinally between crossbars 64 of the bed frame. The ends of brackets 140 are secured to the crossbars by bolts (not shown). Bracket 140 is useful if the deck segment or segments of interest do not have a suitable, preexisting rail 68 to which the bracket can be attached. FIGS. 16-18 are views of bracket 140 shown in the context of a bed frame but with the mounting bolts not illustrated.

Although this disclosure refers to specific embodiments, it will be understood by those skilled in the art that various changes in form and detail may be made without departing from the subject matter set forth in the accompanying claims.

We claim:

1. A bed comprising:

a fixed width deck center section having a width and an outboard edge;

a left wing and a right wing movably coupled to the center section, the left wing including a left leadscrew receiver nonmovably affixed thereto and the right wing including a right leadscrew receiver nonmovably affixed thereto;

a motor assembly mechanically grounded to the center section;

left and right oppositely handed leadscrews each having a rotational axis, the left leadscrew being coupled to the motor assembly and to the left leadscrew receiver, the right leadscrew being coupled to the motor assembly and to the right leadscrew receiver;

wherein operation of the motor is capable of moving the wing between a deployed position in which a lateral extremity thereof is outboard of the outboard edge and a stored position in which the lateral extremity is inboard of its deployed position; and wherein operation of the motor in a first rotational direction moves each wing in unison in a laterally outboard direction and operation of the motor in a second rotational direction moves each wing in unison in a laterally inboard direction.

2. The bed of claim 1 in which when the wing is in its stored position the lateral extremity thereof is outboard of the outboard edge.

3. The bed of claim 1 in which when the wing is in its stored position the lateral extremity thereof is substantially aligned with the outboard edge.

4. The bed of claim 1 in which when the wing is in its stored position the lateral extremity thereof is inboard of the outboard edge.

5. The bed of claim 1 in which the fixed width section includes a pair of longitudinally spaced apart channels and each wing comprises a pair of longitudinally spaced apart spars and a connector, which includes the leadscrew receiver, spanning between the spars, each spar being captured in one of the channels and laterally translatable relative to the fixed width section.

6. The bed of claim 1 in which the motor assembly includes a gear train.

7. The bed of claim 1 in which the center section comprises at least two longitudinally distributed deck segments, at least two of the deck segments being width adjustable deck segments having the left and right wings coupled thereto, each width adjustable segment also having a single motor assembly associated therewith for moving the wings coupled to that same segment.

8. The bed of claim 1 in which the center section comprises at least two longitudinally distributed deck segments, at least two of the deck segments being width adjustable deck segments having the left and right wings coupled thereto, the wings of at least two of the width adjustable segments being movable by a common motor assembly.

9. The bed of claim 8 wherein one of the wings movable by the common motor assembly is a master wing driven directly by the common motor and the other movable wings are slave wings connected to the master wing by a link.

* * * * *